US007007867B1

(12) United States Patent
Drapeau

(10) Patent No.: US 7,007,867 B1
(45) Date of Patent: Mar. 7, 2006

(54) TRIGGER SPRAYER NOZZLE PROVIDING FLOW IN VARIOUS DIRECTIONS

(76) Inventor: Raoul East Drapeau, 2410 Luckett Ave., Vienna, VA (US) 22180

( * ) Notice: Subject to any disclaimer, the term of this patent is extended or adjusted under 35 U.S.C. 154(b) by 43 days.

(21) Appl. No.: 10/907,407

(22) Filed: Mar. 31, 2005

(51) Int. Cl.
*A62C 31/02* (2006.01)

(52) U.S. Cl. ..... 239/394; 239/333; 239/392; 239/601

(58) Field of Classification Search ..... 239/333, 239/390, 392, 394, 397, 477, 478, 506, 513.6; 222/380, 383.1, 402, 1
See application file for complete search history.

(56) References Cited

U.S. PATENT DOCUMENTS

| | | | | | |
|---|---|---|---|---|---|
| 2,997,243 | A | * | 8/1961 | Kolb | 239/394 |
| 3,083,872 | A | * | 4/1963 | Meshberg | 239/394 |
| 3,284,007 | A | * | 11/1966 | Clapp | 239/392 |
| 3,967,765 | A | | 7/1976 | Micallef | |
| 4,247,048 | A | | 1/1981 | Hayes | |
| 4,706,888 | A | | 11/1987 | Dobbs | |
| D321,315 | S | | 11/1991 | Halm et al. | |
| 5,251,820 | A | | 10/1993 | Ho | |
| 5,421,519 | A | * | 6/1995 | Woods | 239/394 |
| 5,639,026 | A | * | 6/1997 | Woods | 239/394 |
| 5,878,959 | A | | 3/1999 | Smolen | |
| 6,126,090 | A | | 10/2000 | Wadsworth | |
| 6,446,842 | B1 | * | 9/2002 | Stern et al. | 222/402.1 |
| 6,508,415 | B1 | | 1/2003 | Wang | |
| 6,752,296 | B1 | | 6/2004 | Sweeton | |

* cited by examiner

*Primary Examiner*—Steven J. Ganey

(57) ABSTRACT

A nozzle and cap structure is provided for a trigger-type pump sprayer allowing the user to conveniently reach top surfaces of objects above the user, as well as lower surfaces of objects below waist level, as well as any application for which the ability to direct the flow of liquid from such a sprayer in an upward or downward direction. A typical application is agricultural sprays such as insecticides, anti-fungal and anti-desiccants where both upper and lower surfaces of leaves should be coated. There also exists a vast array of applications for this device configuration where other hard-to-reach (or hard to treat) regions are involved, including both hand-held operations and remotely mechanized applications. The outlet or orifice of the nozzle cap is angularly configured relative to nozzle feed so that output is at an acute angle relative to the nozzle axis. A number of angular outlets may be provided in an adjustable cap. Through this arrangement, the fluid projecting or spraying device can remain in a nearly vertical orientation, and yet the flow will be at variously selected and fixed acute angles to the nozzle cap axis, depending on an adjustment of the cap position.

20 Claims, 4 Drawing Sheets

TRIGGER SPRAYER NOZZLE PROVIDING FLOW IN VARIOUS DIRECTIONS

FIELD OF THE INVENTION

This invention relates to an improvement to the nozzles used on trigger-actuated pump sprayers.

DESCRIPTION OF RELATED ART

Existing sprayers, for example, hand-held trigger-actuated pump sprayers or dispensers shown in Haim et al. U.S. Des. 321,315 have important disadvantages when they are used to spray agricultural chemicals such as insecticides and anti-desiccants, or other treatment material on plants. Many such chemicals should be applied to both the top and bottom surfaces of the leaves for full effect. However, prior art nozzles, whether in the spray or stream position, present one dispensing orifice (hereinafter referred to as orifice) or several orifices, all directing an output flow straight ahead, and generally away from the user. There are many existing nozzle designs of this kind, as typified by Micallef, U.S. Pat. No. 3,967,765; Smolen, U.S. Pat. No. 5,878,959 and Wadsworth U.S. Pat. No. 6,126,090.

Thus, when it is necessary to apply a spray of treatment material to both the upper and lower side of a leaf, this mode of dispensing requires the user to direct the flow downward or upward by bending the wrist to achieve the desired effect. When the plant is high, it is hard to bend the wrist in such a way as to point the flow downward to reach the tops of the leaves. Similarly, for leaves lower down on the plant, say below waist level, it is equally hard to bend the wrist in such a way as to point the flow upwards to reach the lower surface of the leaves. The only portion of the plant that is relatively easy to reach with the flow is in a narrow range relative to the height of the user. This same problem occurs in other applications where a flow of liquid is required at inconvenient locations above or below easy reach, and it is true of dispensers that are mechanically deployed as opposed to manually applied.

There are several examples in the prior art of sprayers whose nozzle can be aimed in various directions, e.g. Ho, U.S. Pat. No. 5,251,820 and Wang U.S. Pat. No. 6,508,415 and thus achieve the intended result of the present invention. However, these devices are not of the simple, self-contained trigger sprayer kind as described in Micallef, Smolen and Wadsworth above, or are intended as hose-end sprayers.

Accordingly, it is the purpose of this invention to present a trigger-actuated pump sprayer nozzle that does not have the inherent disadvantage of prior art sprayers in the application described.

BRIEF SUMMARY OF THE INVENTION

Definitions

1. Trigger-actuated pump sprayer—one of a class of normally hand-held, self-contained spraying or dispensing devices that includes a container surmounted by a nozzle assembly operatively interconnected to a hand-operated pump, a drawing tube that extends generally downwardly into the fluid to draw up the fluid into the pump, a nozzle tube to conduct the pumped fluid from the drawing tube towards a nozzle cap, and a trigger mechanism for providing pumping force. Of course, such spraying devices may also be remotely operated, as for example on extended booms fed by supply tanks, and be applied to surfaces well beyond a user's normal reach. In those modes, too, the inventive details apply as well.

2. Sprayer head (also known as a dispenser head)—the mechanism mounted on the container that contains the elements required to pump fluid from the container and spray it in a forward direction.

3. Mixing chamber—A component of the nozzle in communication with the orifice that accepts fluid from passageways leading from the nozzle tube and may be configured to impart a swirling motion of the fluid prior to ejection from the orifice. Other designs of mixing chambers can avoid the swirling motion, depending on the intended application.

4. Swirl chamber—a mixing chamber specifically designed to produce a swirling motion of the fluid prior to ejection from the orifice.

5. Sealing boss—a continuous or partial protuberance or ridge molded into a surface, or otherwise affixed or attached thereto, adapted to sealably interconnect two substantially flat surfaces.

6. Nozzle assembly—that part of the sprayer head that carries the fluid from the pump towards the nozzle cap and the nozzle cap itself.

7. Nozzle tube—the tubular member portion of the nozzle assembly that conducts fluid from the pump towards the nozzle cap. The nozzle tube can have various sub-members that provide fluid conduction paths and support for the nozzle cap.

8. Nozzle cap—the outer member of the nozzle assembly that contains the orifices. The cap can rotate with respect to the nozzle axis.

9. Nozzle axis—an imaginary line running substantially parallel with the nozzle tube axis and is normally, generally horizontal in orientation when the sprayer is in use.

10. Trigger—the pivoted or otherwise articulated arm or implement that allows the user to provide compressive force to operate the fluid pump within the sprayer head.

The current invention eliminates the disadvantages of not being able to conveniently reach the tops of the upper leaves of tall plants, as well as the under surfaces of the lower leaves of a plant with the dispensed stream from a trigger-type pump sprayer. Such a sprayer need not necessarily be hand-held, but may instead be an automated remote applicator, as for example in a large botanical complex. Moreover, the present invention similarly applies to environments where spray-type devices are called upon to deliver, for example, paints, lubricants, solvents, soap solutions, and the like, all frequently presenting challenging angles of spray application. For descriptive purposes only, and in no way intended as limiting the scope of the present invention, a leaf-spraying environment is discussed herein, utilizing a hand-held sprayer.

These sprayers accomplish their change in flow type by rotating the nozzle cap relative to the nozzle axis into one of several different positions. These positions can include stream, spray, mist, foam and off positions, for example. Existing technologies in this field include many different internal design details directed toward accomplishing these various flow patterns, some using a single orifice and others using multiple orifices. The common thread however, is the use of an orifice in the rotating cap, and a structure lying directly beneath the orifice that guides the output in a manner to achieve the desired flow type. For example, it is common to use a mixing chamber, well-known in the art, to swirl the fluid and thus achieve a spray effect and to use a different path that bypasses the swirling motion to produce a narrow stream flow.

The current invention solves this problem of inconvenient use for the described application by orienting the orifice of the nozzle cap so that its flow direction is at an acute angle relative to the nozzle axis, whereas in existing technology, it is parallel to the nozzle axis. Thus, the attached container can be held in its usual generally vertical orientation, and yet the flow will be at an acute angle to the nozzle cap rotational axis. Typically, this angle would be between 45 and 75 degrees to the nozzle axis, though of course this angle is not necessarily so limited. This ability to change fluid flow direction in various positions of the nozzle cap has not been addressed in the prior art.

The present invention is a dispensing apparatus which includes a two-piece nozzle assembly, including a rotatable nozzle cap and an underlying nozzle tube element acting as support for the nozzle cap and as a conduit or guide way for the fluid sprayed from the pump mechanism (not part of the current invention). The nozzle assembly of the present invention produces an angled flow by rotating the nozzle cap body into various positions, to bring an orifice into communication with the underlying source of fluid.

Depending on the number of orifices used, the resulting flow direction can be generally straight-ahead, upwardly at one or more angles and downwardly at one or more angles. By including rotational-position-dependent internal flow structures, the present invention could also include the various flow patterns, as well as flow direction.

A typical implementation would include three orifices, each offset from the cap rotational axis and each designed to produce a flow in a fixed angle relative to the nozzle axis. When these three orifices are arranged into four distinct and angularly spaced-apart nozzle cap positions, the arrangement can produce flow directions from a single flow chamber as follows; 45° up, straight-ahead, 45° down and OFF, for example.

As the cap is rotated from position to position, each orifice is aligned to communicate with the single flow chamber and the flow is directed accordingly. The OFF position is achieved by rotating the cap so as to bring the cap position without an orifice over the chamber, thus blocking flow. More complex nozzles, still lying within the intent of the current invention, could include fewer than three orifices, or more than four nozzle cap positions, such as up spray or stream, straight-ahead stream or spray and finally down spray or stream. These variations are examples, and all will be described shortly.

With the present invention, the user has complete control over the kind and direction of the flow of the resulting spray or stream, thus making it considerably easier and more convenient, for example in reaching all the leaf surfaces of a plant.

In addition to facilitating plant spray applications, the present invention could also be used, as suggested above, in any application that calls for spraying liquids or other fluidized materials from trigger-actuated pump sprayers or the like, on surfaces that are not conveniently reached by bending the wrist to direct the spray or stream generally upward or downward. Other such applications include spraying water or starch on clothing to be ironed, water or fertilizer on indoor plants and home insecticides.

There are several variations of this nozzle invention that will be described; all of which fall within the scope of the depending claims. All the parts of the present invention may be made in a variety of ways, as by machining, molding, extruding and so on. Further, both the nozzle cap and nozzle tube as well as other elements may be fabricated by conventional injection molding.

There is no commercially-available product known that provides the described improvement to a trigger-actuated pump sprayer nozzle.

DETAILED DESCRIPTION OF THE INVENTION

Figure 1:
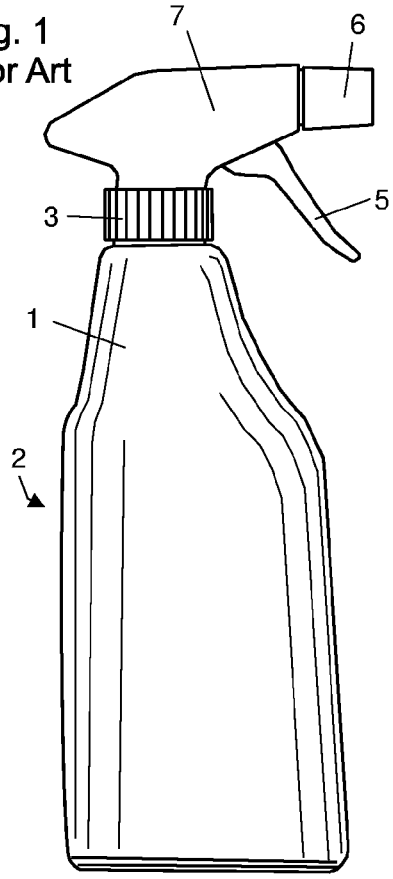
Fig. 1 Prior Art
FIG. 1 shows a side view of a typical trigger-actuated pump sprayer, accordingly designated as Prior Art.

A Prior Art sprayer 2, of which the current invention is an improvement, is shown in FIG. 1. The sprayer has a container 1, a sprayer head 7 with nozzle inside (not shown), nozzle cap 6 and screw cap 3 that holds the sprayer head 7 in place on the container 1. The user squeezes, or depresses trigger 5 in order to actuate the pump mechanism inside the sprayer head 7 and cause the flow of fluid or other treatment material through the nozzle and out the orifice in the cap.

Figure 2:
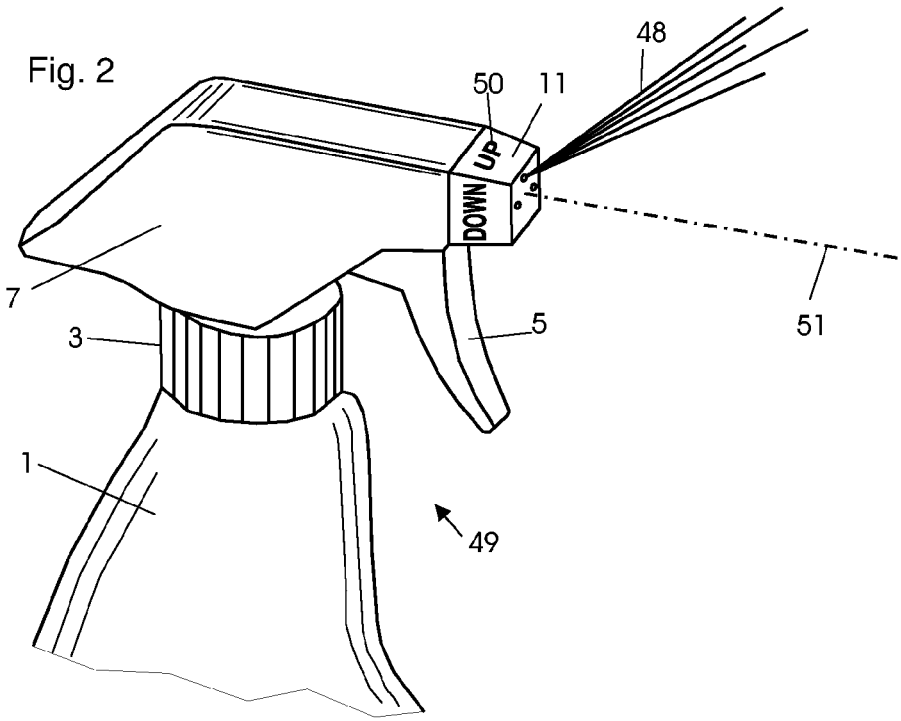
FIG. 2 shows a portion of an improved trigger-actuated pump sprayer representing the present invention.

FIG. 2 illustrates a view similar to FIG. 1, but showing a multi-orifice cap element providing for selectively angled spray directions in accordance with the present invention. Shown are sprayer 49, container 1, a sprayer head 7 with nozzle inside (not shown), nozzle cap 11 that rotates around nozzle axis 51 and screw cap 3 that holds the sprayer head 7 in place on the container 1, trigger 5 that actuates the pump mechanism inside the sprayer head 7 to cause the flow of fluid or other treatment material 48 through the nozzle and out the orifice in the cap, in this case at an upward acute angle.

Figure 3:
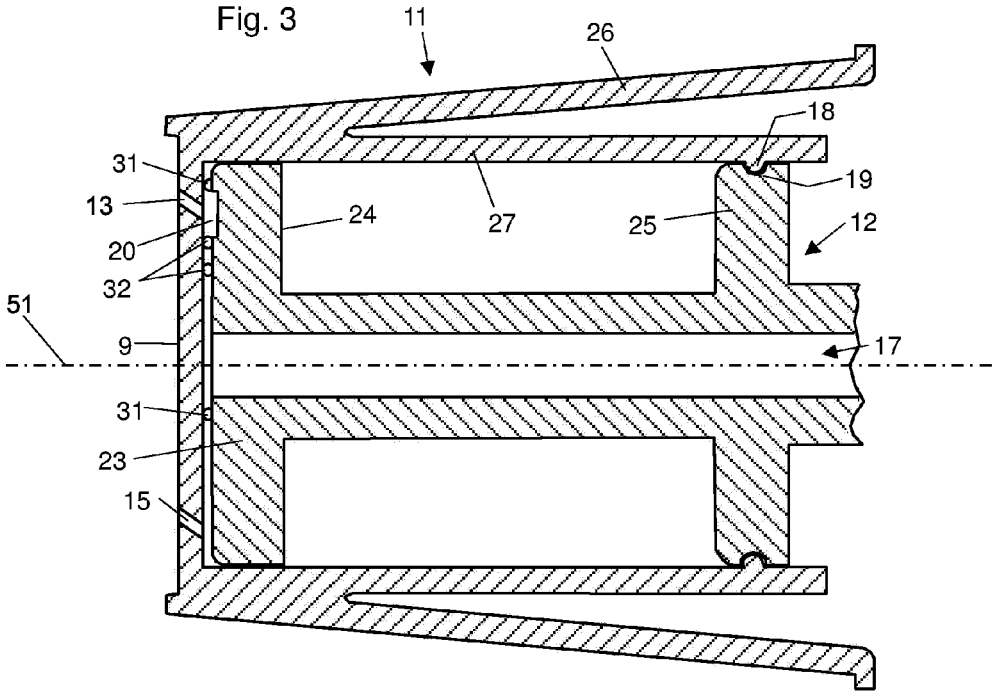
FIG. 3 shows a side cross-sectional view of the nozzle cap and end of the nozzle tube of the sprayer of FIG. 2.

FIG. 3 is a cross-sectional view of the nozzle cap 11 and the end portion 12 of the sprayer nozzle tube. The portion of the nozzle tube that communicates with the pump mechanism is not part of this invention and is not shown here. For reference to detail, consult FIG. 4, which is an enlargement of a portion of the same drawing. The nozzle cap 11 consists of an outer member 26, inner member 27 and an end portion 47 presenting an outer, forward-facing surface 9 and a corresponding substantially flat inner, rearward-facing surface (or rear face) 8. The outer surface of the outer member 26 can have any desired profile, usually either round with ridges to prevent slipping as in Micallef, or square with indentations as in Wadsworth or with molded-in labels as in Sweeton U.S. Pat. No. 6,752,296.

The inner surface of the inner member 27 is round or annular, to allow for rotation of the nozzle cap around the central axis 51 of the nozzle tube. The inner member 27 has a continuous bead 18 that mates with a continuous, or partially continuous, recess 19 in a first substantially disk-shaped member 25 shown as affixed to, or integral with, nozzle tube 12 and projecting generally radially therefrom to engage at bead 18. These two elements provide a snap-together joint that holds the two components together after assembly while permitting rotation of the nozzle cap about the nozzle axis 51.

A second substantially disk-shaped member 23 is illustrated as integral with, or otherwise affixed at or adjacent to, an outer end of nozzle tube 12 and having a forward facing surface, or front face, 29 and a rearward facing surface 24.

Further, sealing bosses 31 and 32 are molded into, or otherwise affixed to, front face 29 (see also FIG. 6) which is spaced apart from rearward-facing surface 8 of end portion 47. Said sealing bosses 31 and 32 are adapted to engage firmly against the rear face 8. Alternatively, such bosses may be affixed or molded to front face 8 and adapted to sealingly engage face 48. As is well-known in the art, the nozzle cap and nozzle tube may be fabricated or constructed of materials of different hardness one from the other, so that an effective seal results therebetween when the harder material of the bosses (for example) presses into a softer material of the cap.

Also shown is mixing chamber 20 molded, or otherwise formed in the front face 29, and two orifices 13 and 15 in the nozzle cap end portion 47. It will be understood that the exact configuration of the bosses, mixing chamber and other dimensions will depend on the particular fluid used and the volume, shape, and rate of dispensing desired.

The orifice 13 is oriented such that the flow of fluid emerging from the mixing chamber will be directed upwards as viewed in the illustrated orientation. Note that if the nozzle cap is rotated, for example, 180 degrees, orifice 15 will be in place over the swirl chamber and the flow will then be directed downwards. A third orifice 14, not visible in FIG. 3, whose flow axis is generally or substantially parallel to the nozzle axis 51, is shown in FIG. 5.

A detent to define and fix the various rotational positions of the nozzle cap relative to the underlying nozzle tube is not depicted in this figure, but is well known in construction and application and thus is not illustrated here. For example, such a detent may take the form of a molded detent that selectively moves to a locking recess and is held therein by friction or pressure fit. On moving the detent to a new position, it gives up its earlier pressure fit and accepts a new fit at a new location.

Figure 4:
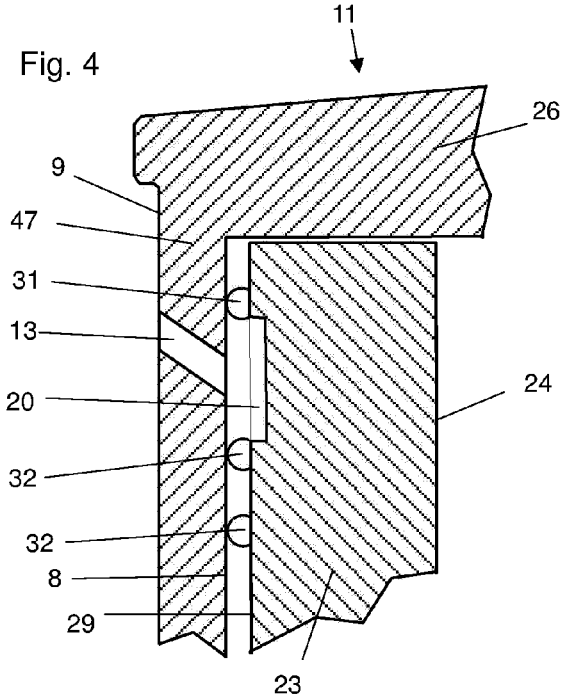
FIG. 4 shows an enlargement of a portion of the same view of FIG. 3.

FIG. 4 is an enlargement of the upper portion of the nozzle cap and tube cross-section of FIG. 3. Shown more clearly here is the relationship between the bosses 31 and 32, the mixing chamber 20 and the nozzle cap 11 surfaces 9 and 8 and the surfaces 29 and 24 of nozzle disc 23.

Figure 5:
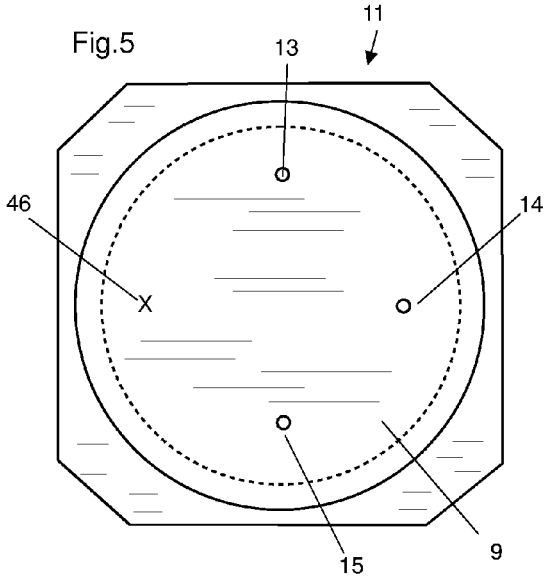
FIG. 5 shows an end view of the improved nozzle cap.

FIG. 5 is an end view of the nozzle cap 11 showing outer surface 9 and at least three orifices 13, 14 and 15. These three orifices allow the user to produce at least three different flow directions as previously indicated; upward with 13, generally straight ahead with 14 and downward with 15. Naturally, any desired angle of flow or any other number of orifices, each with its own defined flow angle could be used. The fourth nozzle cap position shown at 46, indicated by an "X" would normally be used as an "OFF" position, but could also be used for an additional orifice.

Figure 6:
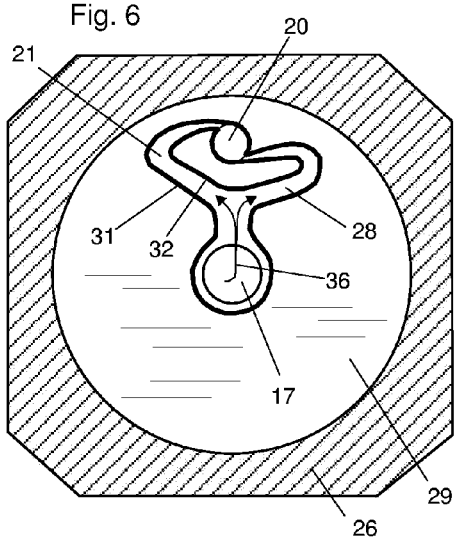
FIG. 6 shows an end view of the outer surface of the nozzle tube with a swirl chamber.

FIG. 6 is a view of the front surface 29 of nozzle tube member 23, showing the inner fluid pathway 17 of the nozzle tube, the mixing chamber 20 and two continuous bosses, 31 and 32. These bosses define two narrow chambers 21 and 28 between the surfaces 8 and 29 that carry substantially equal amounts of fluid 36 into each of two tangential entry points of the mixing chamber 20 and then into and through the orifice (not shown here). This arrangement produces a rotational swirling or spiraling motion of the fluid prior to its ejection from the orifice, thus resulting in a spray effect rather than a stream.

Figure 7:
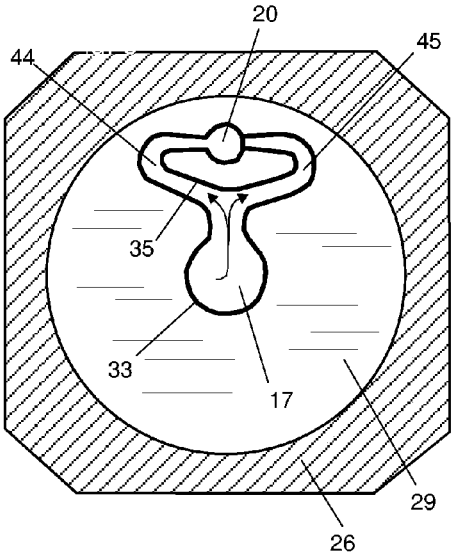
FIG. 7 shows an end view of the outer surface of the nozzle tube with a flow-through chamber.

FIG. 7 is similar to FIG. 6, except that the bosses 33 and 35 define fluid paths 44 and 45 that lead fluid into the mixing chamber 20 in a manner that does not produce swirl. A given implementation of the current invention could employ either kind of mixing chamber without departing from the intended purpose; permitting angled flow of the pumped fluid with respect to the nozzle axis 51.

Figure 8:
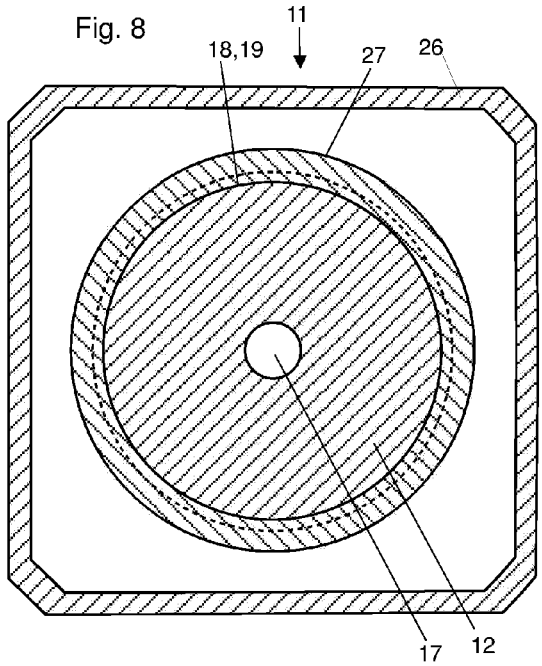
FIG. 8 is a cross-sectional view through the nozzle tube.

FIG. 8 is a cross-sectional view of the cap 11, its outer member 26, its inner member 27 and a disk-shaped member 25 of the nozzle tube 12 at the location of the continuous bead 18 and recess 19. Shown also is the fluid conduction tube 17 member of the nozzle tube 12.

FIGS. 9–12 are cross-sectional views of a portion of the front face 9 and rear face 8 of the nozzle cap 11 with various orifice designs. All of the illustrated designs will produce a fluid flow at an acute angle with respect to the nozzle axis 51.

Figure 9:
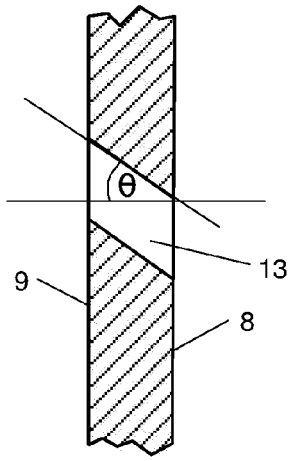
FIG. 9 is a cross-sectional view of a portion of the nozzle cap showing a simple angled orifice.

FIG. 9 shows an orifice 13 set at a fixed angle $\Theta$ with respect to the nozzle axis 51.

Figure 10:
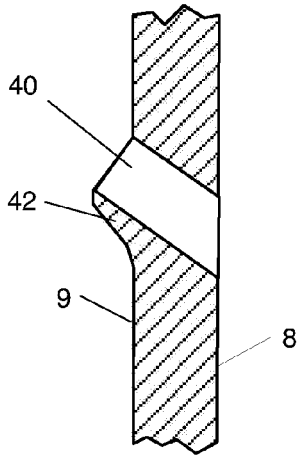
FIG. 10 is a cross-sectional view of a portion of the nozzle cap showing a more complex angled orifice having a raised exit throat.

FIG. 10 shows an orifice 40 whose outer profile contains a raised portion 42 to produce an exit throat that is perpendicular to the orifice axis, and thus produce an improved fluid flow.

Figure 11:
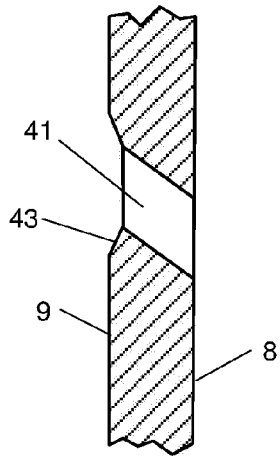
FIG. 11 is a cross-sectional view of a portion of the nozzle cap showing an angled orifice with a substantially conically depressed exit profile.

FIG. 11 shows a fixed angle orifice 41 with a conical throat, again to achieve certain spray effects.

Figure 12:
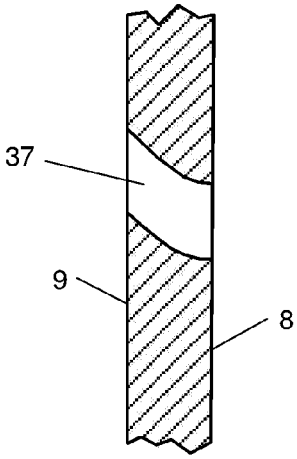
FIG. 12 is a cross-sectional view of a portion of the nozzle cap showing an orifice with a curved profile forming a transitional passageway.

FIG. 12 shows an orifice 37 whose interior surface is curved, such that the inner throat is substantially perpendicular to the inner surface 8, yet the fluid issues at surface 9 at an acute angle relative to the inner passage and said nozzle axis 51, thus forming a transitional passage. These and other orifice designs can be used in any desired combination to achieve the desired flow effect, all without departing from the intended purpose; permitting angled flow of the pumped fluid with respect to the nozzle axis 51.

Figure 13:
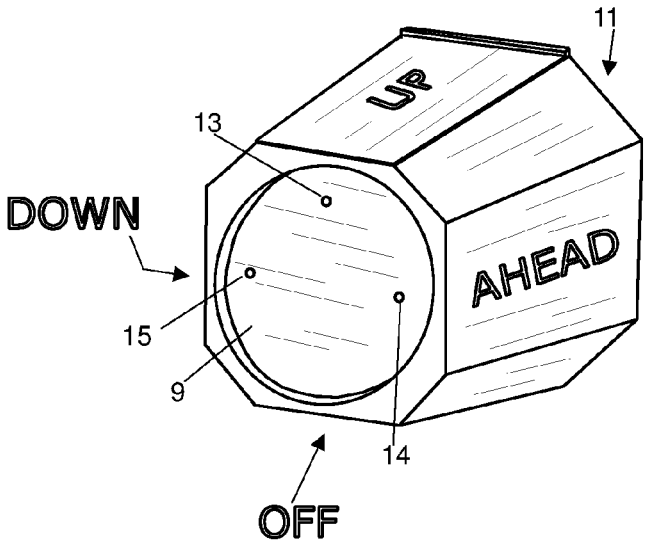
FIG. 13 is a perspective view of the nozzle cap.

FIG. 13 is a perspective view of the nozzle cap 11, showing the orifices 13, 14 and 15, the front surface 9 and directional or flow designation labels UP, AHEAD, DOWN and OFF.

In use, the nozzle cap-adjustment device of the trigger actuated pump sprayer is initially, angularly adjusted away from its non-dispensing position (at "OFF") and reset for a specific directional projection of treatment material spray as would be anticipated for the task at hand. During the spraying process, spraying may be ceased momentarily and the nozzle cap angularly adjusted so as to designate a new direction, e.g., upward or downward, or for such other directional angles as may be appropriate.

In situations where the present invention would not be embodied as a hand-held or otherwise manually operated device, a remote control mechanism may be appropriate. This remote mechanism may be electronically automated or remotely, mechanically manipulated. Further, the treatment material output may be continuous while directional adjustments are effected rather than momentarily ceasing the dispensing action as suggested above.

In any case, when operation is to be ceased, the nozzle cap-adjustment is simply repositioned to "OFF." Alternative settings may be provided to add "SPRAY" or "STREAM" options as is well known in the art. The utilization of specific orifice designs will serve to enhance the flow characteristics as explained hereabove.

Upon careful review of the foregoing specification and drawings, it will be evident that this invention is susceptible of many modifications, combinations and alterations which may differ from those specifically set forth. The particular arrangements disclosed are meant to be illustrative only and not limiting as to the scope of the invention which is to be given the full breadth of claims appended hereto and any and all equivalents thereof.

What is claimed is:

1. In an apparatus for dispensing treatment material including a material source, a pump mechanism to move said material through a passageway to a defined apparatus outlet, and a nozzle assembly including a nozzle element for directing a flow of said treatment material from said source and along a nozzle axis to said outlet, the improvement comprising:

an inner nozzle element having an inward and an outward end, both communicating with said passageway;

said inner nozzle element arranged generally along said nozzle axis and defining a chamber at said outward end thereof;

said chamber adapted to re-direct said treatment material flow along a path outwardly from said nozzle axis toward a location at said outer end for communication with said defined apparatus outlet;

said apparatus outlet is formed as at least one defined outlet orifice, said at least one outlet orifice shaped and adapted to redirect said treatment material from said location and along a path at an acute angle relative to said nozzle axis;

whereby treatment material drawn by said pump from said supply is forced through said passageway and through said chamber outwardly from said nozzle axis, and redirected subsequently through said at least one outlet orifice at said acute angle so as to exit said apparatus at an angle to said nozzle axis.

2. The apparatus of claim 1 wherein said defined orifice is one of plural orifices, at least one of which is adapted to direct material from said location for communication and in a generally upward direction relative to said nozzle axis.

3. The apparatus of claim 2 wherein at least one other of said plural orifices is defined to direct material from said location for communication and in a generally downward direction.

4. The apparatus of claim 3 wherein at least one other of said orifices is defined to direct material from said location for communication and in a direction generally along, or substantially parallel to, said nozzle axis.

5. The apparatus of claim 4 wherein an orifice closure is adapted to be selectively positioned at said location for communication so as to shut off flow from said inner nozzle.

6. The apparatus of claim 5 wherein a cap element is adapted to cover said outward end of said inner nozzle element, and said plural orifices are defined as located on said cap element.

7. The apparatus of claim 6 wherein said cap element is adapted to be selectively positioned so as to place a selected orifice adjacent said location for communication;

whereby selective placement of one or more of said orifices determines a direction of material distribution from said apparatus.

8. The apparatus of claim 1 wherein said chamber is a mixing chamber adapted to impart specific flow characteristics to said flow of treatment material therethrough.

9. A material dispenser nozzle assembly comprising:

an inner nozzle element having an inward and an outward end surrounding an inner passageway adapted to conduct said treatment material from said inward end to said outward end;

said inner nozzle element defining a nozzle axis along which said treatment material is conducted;

said inner nozzle including an outlet defined at the outer end thereof, positioned at an outlet location spaced from said nozzle axis;

a nozzle cap member supported by, and rotatably mounted on, said inner nozzle element, and including at least one dispensing orifice adapted to be selectively positioned in alignment with said outlet location;

the nozzle cap member and inner nozzle outer end are spaced apart at said outer end so as to define an outward passage for said treatment material flowing from said inner passageway to said outlet location;

said at least one defined dispensing orifice is configured at an acute angle relative to said nozzle passageway and axis;

whereby treatment material flowing through said inner passageway and through said outward passage is redirected through said at least one dispensing orifice at said acute angle so as to exit said cap of said nozzle assembly at an angle to said inner passageway and nozzle axis.

10. The material dispenser nozzle of claim 9 wherein the at least one dispensing orifice is one of plural orifices, at least one of which is adapted to direct material from said outlet location in a generally upward direction relative to said nozzle axis.

11. The dispenser nozzle of claim 10 wherein at least one other of said plural orifices is defined and configured to direct material from said outlet location in a generally downward direction relative to said nozzle axis.

12. The dispenser nozzle of claim 11 wherein at least one other of said orifices is defined and configured to direct material from said outlet location in a direction generally along, or substantially parallel to, said inner passageway and nozzle axis.

13. The dispenser nozzle of claim 12 wherein an orifice closure is adapted to be selectively positioned at said outlet location so as to shut off flow from said inner nozzle.

14. The dispenser nozzle of claim 13 wherein said nozzle cap member defines multiple orifices positionally spaced along the surface thereof, each with a different, angular configuration relative to the inner passageway and nozzle axis;

said nozzle cap member includes identifying indicia as positional guidance for rotatably adjusting said cap;

whereby selective placement of one or more of said orifices determines a direction of material distribution from said dispenser nozzle.

15. The dispenser nozzle of claim 14 wherein said nozzle cap member defines an angular orifice with a central flow axis, and further defines an outer profile in the form of a raised cap surface portion forming an exit throat perpendicular to said central flow axis.

16. The dispenser nozzle of claim 14 wherein said nozzle cap member defines an angular orifice with a conically recessed exit throat.

17. The dispenser nozzle of claim 14 wherein said nozzle cap member defines an angular orifice with a curved interior, wherein an inner segment of said orifice is defined as perpendicular to said outward passage, and with an exit segment defined at said acute angle to said inner passage and nozzle axis, to form a transitional passage.

18. The material dispenser nozzle assembly of claim 9 wherein at least one of said cap and inner nozzle outer end is provided with sealing bosses disposed between said nozzle cap member and said inner nozzle outer end so as to be disposed in and to further define said outward passage for said treatment material flowing from said inner passageway to said outlet location.

19. The material dispenser nozzle assembly of claim 18 wherein said sealing bosses are fabricated of materials of different hardness from a surface against which it is to abut;

whereby a boss portion of a nozzle cap would be harder or softer than the inner nozzle outer end against which it abuts and vice versa for a boss portion effective seal when a harder boss material presses against a softer boss material.

20. In an apparatus for dispensing treatment material including a material source, a pump mechanism to move said material through an inner passageway to an apparatus outlet, and a nozzle assembly including a material dispenser nozzle assembly for directing a flow of said treatment material from said source and along a nozzle axis to said outlet, the improvement comprising:

a material dispenser nozzle assembly comprising:

an inner nozzle element having an inward and an outward end surrounding said inner passageway adapted to conduct said treatment material from said inward end to said outward end;

said inner nozzle element defining a nozzle axis along which said treatment material is conducted;

said inner nozzle including an outlet at the outer end thereof, positioned at an outlet location spaced from said nozzle axis;

a nozzle cap member supported by, and rotatably mounted on, said inner nozzle element, and defining at least one dispensing orifice adapted to be selectively positioned in alignment with said outlet location;

the nozzle cap member and inner nozzle outer end are spaced apart at said outer end so as to define an outward passage for said treatment material flowing from said inner passageway to said outlet location;

sealing bosses opposingly disposed on said cap member and said inner nozzle outer end further defining said outward passage;

said at least one dispensing orifice defined on said nozzle cap member is configured at an acute angle relative to said nozzle passageway and axis;

whereby treatment material flowing through said inner passageway and through said outward passage is redirected through said at least one dispensing orifice at said acute angle so as to exit said cap of said nozzle assembly at an angle to said inner passageway and nozzle axis.

* * * * *